United States Patent [19]

Hopkins et al.

[11] Patent Number: 4,750,227

[45] Date of Patent: Jun. 14, 1988

[54] ABRASIVE STRUCTURES AND METHODS FOR ABRADING FABRICS

[75] Inventors: Gregory J. Hopkins; Thomas Holst, Jr., both of Charlotte, N.C.

[73] Assignee: Dexter Chemical Corporation, New York, N.Y.

[21] Appl. No.: 924,216

[22] Filed: Oct. 28, 1986

[51] Int. Cl.[4] ..... D06F 21/04

[52] U.S. Cl. ..... 8/158; 8/159; 51/313; 68/18 F; 68/29; 210/767; 428/91

[58] Field of Search ..... 8/147, 137, 159, 150, 8/102, 158; 51/313, 316; 68/18 F, 29, 30, 142; 428/91; 69/23, 28, 30; 26/19, 28

[56] References Cited

U.S. PATENT DOCUMENTS

| | | |
|---|---|---|
| 8,921 | 5/1852 | Hollingsworth . |
| 16,190 | 12/1856 | Roland . |
| 20,791 | 7/1858 | Harrison . |
| 29,638 | 8/1860 | Threlkeld . |
| 32,469 | 6/1861 | Collier . |
| 82,722 | 10/1863 | Kelly . |
| 247,525 | 9/1881 | Williams . |
| 831,135 | 9/1900 | Barnard . |
| 1,126,906 | 2/1915 | Stelter . |
| 2,942,285 | 6/1960 | Gray . |
| 2,958,593 | 11/1960 | Hoover et al. . |
| 4,227,350 | 10/1980 | Fitzer . |
| 4,287,633 | 9/1981 | Gropper . |
| 4,331,453 | 5/1982 | Dau . |
| 4,355,489 | 10/1982 | Heyer . |
| 4,437,271 | 3/1984 | McAvoy . |
| 4,486,200 | 12/1984 | Heyer . |
| 4,575,887 | 3/1986 | Viramontes . |

FOREIGN PATENT DOCUMENTS 3129699 2/1983 Fed. Rep. of Germany .

OTHER PUBLICATIONS

3M Product Brochure, Scotch-Brite ® Surface Conditioning Products.

*Primary Examiner*—Harvey C. Hornsby
*Assistant Examiner*—Frankie L. Stinson
*Attorney, Agent, or Firm*—Curtis, Morris & Safford

[57] ABSTRACT

An abrasive structure for stone washing garments in a wash medium and a method for abrading garments using that abrasive structure to achieve controlled abrasion of those garments are disclosed. The abrasive structure has a uniform abrasive surface which will not damage or excessively wear fabrics and garments being subjected to the stone washing method, which will not deteriorate during use, and which will provide uniformly stone washed garments having a consistent nap and a low level amount of textile wear. The abrasive structure is formed of a substantially form-retaining material having a resilient abrasive surface. For example, the abrasive structure may be formed of a block of form-retaining material substantially impervious to aqueous washing systems and a resilient layer of synthetic abrasive material substantially surrounding the block and affixed to the exterior surfaces of the block.

3 Claims, No Drawings

ABRASIVE STRUCTURES AND METHODS FOR ABRADING FABRICS

BACKGROUND OF THE INVENTION

This invention relates to abrasive structures for use in the so-called stone washing of fabrics and garments. More particularly, this invention relates to substantially form retaining blocks of material having resilient abrasive surfaces to be used in stone washing processes and to methods for washing fabrics and garments to achieve the controlled abrasion of those garments.

There has arisen in recent years an industry, related to the laundering industry, known as "stone washing." Stone washing is the term used to describe methods for imparting a soft, worn look to new clothes, in particular, denim jeans. Consumers will pay a significant premium for clothes having a soft, worn look, and accordingly, a number of methods have been developed by prior workers for washing new garments and fabrics to cause them to have the desired feel and appearance.

Among the prior art methods employed for stone washing are those wherein large pumice stones, i.e., stones 2 to 4 inches or more in diameter, are used in the washing machine. These large stones circulate with the garments during the wash cycle and cause the garments to abrade and soften. There are major problems with this method, however, among them being that the stones break, they collide with the washing cylinder during agitation and cause damage thereto, and, most importantly, they cause damage to the garments themselves. The latter is caused, it is believed, when pumice stones strike one another or strike the washing cylinder and a garment or portion thereof is caught in between. This creates holes in the garments and makes them unsuitable for sale. The pumice stones have also been known to break and form sharp edges and points and these also cause damage to the garments and the washing machine. Still another disadvantage of the pumice stone method is that it is time consuming and labor consuming to remove the stones from the wash cylinder after each cycle and it is inconvenient, if not dangerous, to workers handling the sharp stones. Yet another disadvantage of stone washing methods employing pumice stones is that the stones themselves or fragments thereof actually find their way into the pockets of the garments being washed and they must be removed in a time consuming and labor intensive operation.

A second unsatisfactory method of stone washing involves the abrasion of the wash cylinder by abrasive materials such as volcanic rock. The rough, abraded cylinder surface then contacts the garments during the wash cycle and causes the desired wear and abrasion of the garments. The disadvantages of this method include the time and cost of repeated resurfacings of the wash cylinder and the substantial time and energy required to achieve satisfactory stone washing of the garments in the machine.

A further disadvantage of both prior art methods is that the garments rub against the pumice stones or the wash cylinders where they have been creased and folded during manufacture. The creased and folded areas are worn to a substantially greater degree than the balance of the garment and this results in streaking, unacceptable appearance and sometimes excessive wear of the garment at the crease lines. Garments treated in different stone washing cycles may have different appearance, nap, streaking and wear, and even garments washed in a given cycle may have different appearances as well.

A recent process for stone washing garments is that described in U.S. Pat. No. 4,575,887 wherein a predetermined amount of pumice sand or other small-sized particle abrasive is used to abrade and clean the garments. After agitation in the wash medium containing the pumice sand or like material, the washing machine receptacle is drained and the abrasive material is trapped and separated from the drainage liquid. The filtered abrasive particles are reused in subsequent operations.

The major disadvantage of the processes described in the '887 patent include the abrasion of the inside wall of the cylinder, the costs and time involved in filtering out the pumice from the wash liquid, the need to have one or more subsequent rinse steps to remove the pumice from the garments after the abrasion step, and the formation of pumice deposits in the pockets of garments such as jeans. In addition, there is constant attrition and loss of abrasive material, substantial quantities of abrasive material must be used in each cycle per unit weight of fabric being stone washed (for example, from one to two pounds of pumice sand per pound of garments) and there is a significant rate of deterioration of the commercial washers used to process the garments.

It is thus a primary object of this invention to provide an abrasive structure for use in stone washing of fabrics and garments which is more convenient to handle and more effective in use than the pumice stones, abraded cylinders, and pumice sand of the prior art.

It is a further and related object of this invention to provide an abrasive structure which is easy and inexpensive to manufacture, which can be reused in multiple stone washing cycles and which is not difficult or dangerous to handle.

It is still a further object of this invention to provide an abrasive structure having a uniform abrasive surface which will not damage or excessively wear fabrics and garments being subjected to the stone washing method, which will not deteriorate during use, and which will provide uniformly stone washed garments having a consistent nap and a low level amount of textile wear.

It is a further object of this invention to provide processes for stone washing garments, particularly denim garments, as well as fabrics in general, which are less wearing on the commercial washing equipment, which employ reduced amounts of abrasive material such that energy requirements are less and which provide satisfactory and uniform wear characteristics on the garments which are washed.

SUMMARY OF THE INVENTION

These and other objects of the invention are achieved by employing structures for abrading fabrics in stone washing processes which comprise a substantially form-retaining material having a resilient abrasive surface. Preferably, the abrasive structure comprises (1) a structural form having a substantial exterior surface area, and (2) a layer of an abrasive material affixed to that exterior area. In the most preferred embodiments the structure is a rigid block of polypropylene or other substantially water-impervious polymeric material and the abrasive material is a resilient layer of synthetic abrasive material such as polyester fiber.

In the preferred embodiments, the structure has a substantially rectilinear cross section and is comprised of a block of substantially form-retaining material such as polypropylene which is impervious to aqueous washing systems and a resilient layer of synthetic abrasive material bonded, by an adhesive, or the like, to each of the exterior surfaces of the block.

The structure itself is desirably buoyant, i.e., it has a density less than 1.00, but broadly, blocks having an intrinsic density of from 0.2 to 2.00 can be used to advantage in the stone washing methods of the invention.

The abrasive structure of the invention is substantially rectilinear in its cross section. Desirably, it has a volume of not less than ½ cubic inch nor more than 50 cubic inches and preferably from 1 to 20 cubic inches. Desirably no rectilinear dimension of the abrasive structure is greater than 5 times any other rectilinear dimension of the abrasive structure. Other shapes, such as spheres, ellipsoids, etc., can be used.

The abrasive materials of the type defined in U.S. Pat. No. 2,958,593 and sold under the trademark "Scotch-Brite" by the 3M Company of St. Paul, Minn., are advantageously used to form the resilient synthetic abrasive material. The disclosure of U.S. Pat. No. 2,958,593 is incorporated herein by reference.

The resilient material typically is formed of a lofty open nonwoven three-dimensional web formed of interlaced flexible and durable organic fibers which have a diameter of 25 microns to 250 microns. The web forming the fibrous matrix may be formed of any suitable material which is substantially resistant to water, soaps, bleaches, etc., and capable of withstanding the processing and use conditions as herein described. Preferred materials for the filaments of the matrix include organic materials such as nylon, acrylic fibers, or, even more preferred, polyester fibers.

The fibers are adhesively bonded together at points where they cross and contact one another to form a three-dimensional integrated structure. A network of intercommunicating voids constitutes about 75% of the volume of the resilient material. The binder should be selected so that when cured it is not so excessively brittle as to cause the matrix to fail under the use conditions contemplated. The binder should be sufficiently strong to form a strong adherent bond between the filaments to provide structural integrity to the matrix, yet it should not be so stiff or rigid or applied in such quantities as to interfere with the resilience of the matrix.

Preferably, abrasive granules can be distributed within the web and firmly bonded to the fibers by a relatively hard, rigid binder. The abrasive granules may be any known abrasive material commonly used in the abrasive art, including mineral abrasive granules such as topaz, garnet, alumina, corundum, silicon carbide and zirconia.

The synthetic abrasive material may be made by forming the web by an extrusion process, uniformly coating the filaments of the web with a liquid curable binder resin, depositing the abrasive granules onto the web coating, curing the first binder coating, applying a second coating of liquid curable binder and then curing the binder as described in U.S. Pat. No. 4,227,350, the disclosure of which is also incorporated herein by reference.

The synthetic abrasive material is preferably in a layer of not less than 1/16 nor more than 1 inch in thickness. Desirably, the thickness of the layer of the synthetic abrasive material is ¼ to ¾ inch. The resilient web design of the synthetic abrasive allows a controlled contact between the abrasive block and the fabric. It is believed that the combination of the substantially form-retaining block and the substantially resilient thickness of the synthetic abrasive material provides both the substance and the surface for scouring the fabrics during the wash cycle so as to apply uniformly a washing and scouring pressure to all surfaces of the fabrics with which the abrasive structures come in contact.

The layer of material may be affixed to the underlying block by a suitable adhesive, such as an epoxy resin or contact cement, or other adhesive known in the art. The layer of nonwoven fiber should be substantially uniform around the exterior surface of the block.

The abrasive block of the invention is desirably used in stone washing processes wherein fabrics, particularly denim jeans and the like, are introduced into a washing machine which may be a home or commercial washing machine. Thereafter to the machine is added (a) a sufficient quantity of an aqueous wash medium to carry out the intended washing operation, as is generally understood in the art, and (b) a plurality of abrasive structures as described in this application for abrading the fabric during the wash cycle. The fabrics are then stone washed for a period of time sufficient to wash and abrade the fabrics uniformly, preferably from 10 to 90 minutes. Thereafter the wash water is drained, one or more rinse cycles are conducted and the abraded fabric and the abrasive structures of the invention are removed from the washing machine.

EXAMPLE I

A batch of denim garments weighing 100 pounds is introduced into the receptacle of a commercial washing machine. Five hundred (500) abrasive blocks according to the invention are added to the receptacle as well. Each of the blocks has a polypropylene core and is buoyant, having a density of approximately 0.90. Each block has a layer of synthetic abrasive material affixed to the exterior surfaces thereof. The thickness of the abrasive layer is about ½ inch. Each of the blocks is 1"×2"×3" and has a volume of approximately 6 cubic inches (exclusive of the abrasive layer).

Water at 140°–150° F. is added to the receptacle of the washing machine together with 3% by weight (of garments) of a desizing agent and 3% by weight of a detergent-emulsifier.

The machine is then agitated for 10 to 90 minutes until the garments are fully stone washed. The wash water is then dumped and the garments are rinsed with fresh hot water.

The garments are then bleached in a wash bath at a temperature of 140°–150° F. containing about 10% by weight of garments of a 15% solution of a sodium hypochlorite bleach. The bleach solution is then dumped and the garments are rinsed with fresh hot water.

The garments are then rinsed in a 0.5% by weight of garments of a sodium bisulfite solution to react with any trace amounts of residual bleach to eliminate any bleach odor. The solution is then dumped and the garments are rinsed with fresh hot water.

The garments are then rinsed with a 2% by weight solution of a cationic softener, for example, a fatty amine. The softener solution is drained and the garments are extracted, removed from the machine and dried.

Stone washed jeans of uniform soft worn look and having excellent nap characteristics are obtained.

The stone washing processes of the invention may employ from 0.5 to 10, preferably from 1 to 5, abrasive structures per pound of fabric being stone washed and preferred blocks weigh approximately 0.2 pounds. The abrasive structures can be used over and over again, they do not locate themselves in the pockets of the garments being washed, they are easy to handle and unload from the washing machine and there is substantially no attrition from cycle to cycle. Uniformly stone washed jeans are invariably obtained.

What is claimed is:

1. A method of abrading fabrics in a washing machine comprising the steps of:

(1) introducing, into a washing machine
- (a) fabric,
- (b) a sufficient quantity of aqueous wash medium to carry out the intended washing operation, and
- (c) from 0.1 to 5 abrasive structures per pound of fabric, each of said abrasive structures comprising:
  - (i) a block of form-retaining material substantially impervious to aqueous washing systems; and
  - (ii) a resilient layer of synthetic abrasive material substantially surrounding said block and affixed to the exterior surfaces thereof;

(2) agitating the fabric in the washing machine until it is uniformly washed and abraded;

(3) draining the said aqueous wash medium from the washing machine; and (4) removing the uniformly washed and abraded fabric and said abrasive structures from the washing machine.

2. A method of abrading fabrics in a washing machine comprising the steps of:

(1) introducing, into a washing machine
- (a) fabric,
- (b) a sufficient quantity of aqueous wash medium to carry out the intended washing operation, and
- (c) from 0.5 to 10 abrasive structures per pound of fabric, each of said abrasive structures comprising:
  - (i) a block of polypropylene being substantially rectilinear in cross section and having a volume of from 1 to 20 cubic inches and being sized such that no one rectilinear dimension is greater than 5 times any other rectilinear dimension, said block having substantial exterior surface areas; and
  - (ii) a resilient layer of nonwoven synthetic abrasive material affixed to the said exterior surfaces of said block and substantially surrounding said block;

(2) agitating the fabric in the washing machine until it is uniformly washed and abraded;

(3) draining the said aqueous wash medium from the washing machine; and (4) removing the uniformly washed and abraded fabric and said abrasive structures from the washing machine.

3. A method of abrading fabrics in a washing machine comprising the steps of:

(1) introducing, into a washing machine
- (a) fabric,
- (b) a sufficient quantity of aqueous wash medium to carry out the intended washing operation, and
- (c) from 0.5 to 5 abrasive structures per pound of fabric, each of said abrasive structures comprising a substantially form-retaining material having a resilient synthetic abrasive surface;

(2) agitating the fabric in the washing machine until it is uniformly washed and abraded;

(3) draining the said aqueous wash medium from the washing machine; and (4) removing the uniformly washed and abraded fabric abrasive structures from the washing machine.

* * * * *